United States Patent [19]

Vcala

[11] 4,170,352

[45] Oct. 9, 1979

[54] VISUAL AID PRACTICE TENNIS BALL

[76] Inventor: Vlastimil Vcala, 1228 - 12th St., Santa Monica, Calif. 90401

[21] Appl. No.: 816,895

[22] Filed: Jul. 18, 1977

Related U.S. Application Data

[63] Continuation of Ser. No. 619,825, Oct. 6, 1975, abandoned.

[51] Int. Cl.[2] ..... A63B 61/00

[52] U.S. Cl. ..... 273/29 A; 273/61 R

[58] Field of Search ..... 273/58 R, 58 A, 58 B, 273/58 C, 58 AB, 58 D, 58 E, 58 F, 58 G, 58 H, 58 J, 58 K, 60 R, 61 R, 61 A, 1.5 R, 1.5 A, 29 R, 29 A, 26 R, 95 A, 97 R; D34/15 EE; 46/DIG. 1, 87; 40/327

[56] References Cited

U.S. PATENT DOCUMENTS

| | | | |
|---|---|---|---|
| 280,807 | 7/1883 | Farley | 273/58 R |
| 1,593,211 | 7/1926 | Faulkner et al. | 273/61 R |
| 3,039,773 | 6/1962 | Teeguarden | 273/61 R |
| 3,863,923 | 2/1975 | Anderson | 273/58 BA |
| 3,904,201 | 9/1975 | Henry | 273/61 R |

FOREIGN PATENT DOCUMENTS

| | | | |
|---|---|---|---|
| 854595 | 11/1960 | United Kingdom | 273/61 R |

OTHER PUBLICATIONS

Sporting Goods Dealers Magazine, vol. 146, May 1972, pp. 31-33.

*Primary Examiner*—Richard C. Pinkham
*Assistant Examiner*—T. Brown
*Attorney, Agent, or Firm*—Freilich, Hornbaker, Wasserman, Rosen & Fernandez

[57] ABSTRACT

A tennis training aid comprising a tennis ball having a pair of figure eight panels combining to cover the entire outer surface of the ball. The panels are colored of contrasting colors for indicating the spin or rotation of the ball while in flight wherein the spin imparted to the ball is easily discernible so as to enable a viewer of the ball to determine what type of spin has been imparted to the ball to facilitate learning delivery or receiving maneuvers enabling tennis participants to more effectively participate in the sport of tennis.

1 Claim, 3 Drawing Figures

VISUAL AID PRACTICE TENNIS BALL

This is a continuation of application Ser. No. 619,825, filed Oct. 6, 1975 (abandoned).

BACKGROUND OF THE INVENTION

In the game of tennis, wherein the spin of the ball becomes important to the participant in being able to learn how to impart spin to the ball and therefore exercise some control in delivery of the ball, or alternately, to be able to determine the spin or rotation of the ball when the ball is to be returned, hit or otherwise acted upon, it becomes important to be able to visually perceive the spin or rotation of the tennis ball during flight. For example, in playing tennis, especially in the neophyte stages, the ball delivery becomes important with regard to the type of spin that may be wished to be imparted to the ball so that the opponent will not be likely to return the ball, because of the change in trajectory of the ball in flight caused by imparted spin to the ball, as by contacting the ball in a specific manner with a tennis racket.

In also receiving the ball, a tennis player, in order to return the ball effectively, must ascertain the type of spin which has been imparted to the ball so as to be able to compensate in the return stroke for the spin or rotation of the ball in flight during trajectory. Additionally, visual observation of the spin of the ball will also allow the receiver of the ball to ascertain with some certitude the likely point of impact of the ball, to which a spin has been imparted, and the likely bounce trajectory that the ball will take thereby enabling the player to effectively position himself for return of the ball.

Heretofore, tennis balls, have had no visual means to aid in training in either delivering or returning the ball by determining the spin or rotation of the ball. Traditionally the tennis balls have been an all white or off-white color, or in recent years, of different solid colors making it difficult to know and to effectively perceive the spin that has been imparted to the ball in order to more effectively deliver or return the tennis ball.

With the herein disclosed invention, tennis ball spin is easily ascertained and is perceptible by the utilization of at least surface means on the exterior of the ball which, in conjunction with the remainder of the surface of the ball, produces a dynamic pattern which is easily perceived while the ball is in flight.

OBJECTS AND SUMMARY OF THE INVENTION

It is an object of this invention to provide a visual or training aid for indicating the spin of a tennis ball while in flight.

In accordance with this invention, a dual-panel cover of a conventional tennis ball is provided with one solid color for one panel of the cover and a contrasting color for the other panel of the cover. Each panel has two ends diametrically opposite each other, and when the tennis ball is viewed on an axis passing through the center of each end, and the center of the ball, the end seen appears circular throughout most of its viewed perimeter. The two ends of each panel are connected by a narrow portion which fits closely between the two ends of the other panel. The result is that two colors are seen on the ball when viewed from any direction while the ball is in motion with spin about any axis to give the viewer an indication of the direction of rotation and the axis of rotation.

These and further objects will become apparent from the figures of drawing and the accompanying commentary.

DESCRIPTION OF THE BEST EMBODIMENTS CONTEMPLATED

Figure 1:
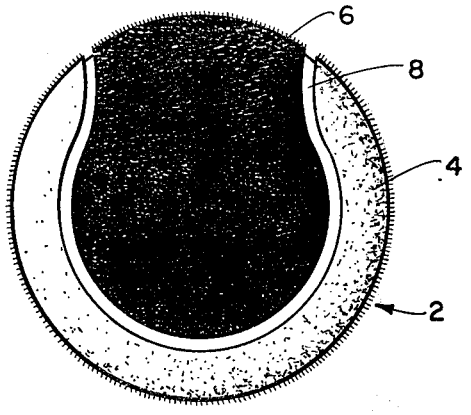
FIG. 1 illustrates a tennis ball with the herein disclosed invention.
Figure 2:
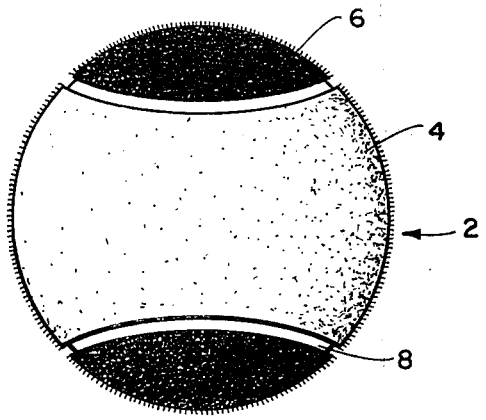
FIG. 2 illustrates another view of the tennis ball illustrated in FIG. 1.
Figure 3:
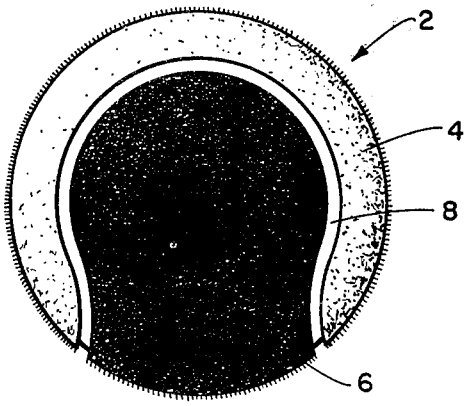
FIG. 3 illustrates still another view of tennis the ball depicted in FIG. 1.

Referring to the various figures of drawing wherein like numerals of reference will designate like elements throughout and referring specifically to FIGS. 1 through 3 inclusive, it will be seen that in accordance with the invention a tennis ball 2, of conventional design and fabrication, is composed of outer or cover panel members 4 and 6 with the contiguous seam 8 therebetween forming in this instance a complete, spherical cover for the ball 2.

The panel 6 in this instance has its outer surface dyed or colored a contrasting color with respect to the other panel 4. In the illustrated instance, the panel 6 is colored black while the panel 4 is the traditionally found white or off-white tennis ball color. It will be noted that the panel 6 comprises approximately 50% of the spherical area of the ball 2. While the panel 6 is described as bearing a surface color such as black, the color may in actuality extend through the thickness of the material comprising the panel. The ball 2 having the contrasting discrete areas would provide a dynamic color pattern indicating to a visual observer the direction of rotation of the ball and the axis of rotation. In the usual case, high optic colors may be utilized such as, for example, optic yellow or some of the other fluorescent colors which have gained some notoriety especially where night tennis is played. A typical color pattern is optic yellow and black or alternately black with the usually found white color as shown in FIGS. 1 through 3 inclusive.

Thus, in the usual and customary manufacture of tennis balls, one of the panels 4 and 6 will be some color other than white, or alternately, where a mixed color is desirable, each will be some color other than white, but with contrasting colors, and the material making up the panels 6 and 4 will carry the color throughout its thickness, or a majority thereof, so that when assembling the manufacturing the completed tennis ball, a ball will be produced which has discrete contrasting color areas which cooperate with each other to produce a pattern effect during flight of the ball to indicate the direction and axis of rotation thereof.

The tennis ball so configured and patterned will not only aid beginners in knowing what type of spin they have imparted to the ball, but will also aid the receiver of the ball to return the ball. Additionally, the ball of the type of the herein disclosed invention will heighten spectator interest during competition matches since the spectator may be able to see the ball and ascertain what type of spin has been imparted to it.

I claim:

1. A conventional tennis ball having a cover comprised of two identically shaped panels of the same size, each panel having rounded ends and concave sides, with a length sufficient to permit each panel to extend partially around the ball such that the geometric center of each rounded end will be diametrically opposite the geometric center of the other rounded end, said centers of a panel being aligned on a common axis passing through the center of said ball, and the axis of one panel being normal to the axis of the other panel, and one panel having a color contrasting with the color of the other panel as an aid to detecting spin imported on the ball while in play.

* * * * *